US005367288A

United States Patent [19]

El Marry

[11] Patent Number: 5,367,288

[45] Date of Patent: Nov. 22, 1994

[54] PORTABLE ALARM DEVICE FOR DETECTING OBJECTS TRANSGRESSING DISTANCE THRESHOLDS

[76] Inventor: Saar M. El Marry, 58, rue Moillebeau, 1209 Geneva, Switzerland

[21] Appl. No.: 18,620

[22] Filed: Feb. 17, 1993

[51] Int. Cl.[5] ..... G08B 13/18

[52] U.S. Cl. ..... 340/553; 340/552; 331/64; 331/65

[58] Field of Search ..... 340/541, 550, 552, 553, 340/561, 331, 332; 331/64, 65, 167, 109, 183, 117 R

[56] References Cited

U.S. PATENT DOCUMENTS

| | | | |
|---|---|---|---|
| 3,328,721 | 6/1967 | Hehenkamp et al. | 331/109 |
| 3,761,908 | 9/1973 | Gehman | 340/553 |
| 4,197,537 | 4/1980 | Follen et al. | 340/552 |
| 4,215,341 | 7/1980 | Cole | 340/552 |
| 4,313,118 | 1/1982 | Calvin | 343/701 |
| 4,920,281 | 4/1990 | Harris | 340/552 |
| 5,227,764 | 7/1993 | Umemoto | 340/552 |

FOREIGN PATENT DOCUMENTS

| | | | |
|---|---|---|---|
| 0041781 | 12/1981 | European Pat. Off. | G08B 13/26 |
| 1478754 | 4/1966 | France | G08B 13/24 |
| 1030537 | 5/1966 | United Kingdom . | |
| 1378036 | 12/1974 | United Kingdom | G01S 9/42 |
| 1448814 | 9/1976 | United Kingdom | G08B 13/24 |
| 8807732 | 10/1988 | WIPO | G08B 13/18 |

OTHER PUBLICATIONS

British Search Report—Jan. 29, 1991.
European Search Report Jul. 15, 1992.

*Primary Examiner*—Victor R. Kostak
*Assistant Examiner*—John W. Miller
*Attorney, Agent, or Firm*—Panitch Schwarze Jacobs & Nadel

[57] ABSTRACT

An alarm apparatus comprises an oscillator circuit (20) which provides an oscillating current to an antenna (A) from where a location (1) to be surveyed is irradiated with electromagnetic waves of in the RF frequency range provided by the oscillator circuit (20). The oscillator and the antenna are slightly mismatched with respect to their resonance frequency so as to avoid the oscillation current to go into resonance. Reception in the antenna (A) of an in-phase reflection of the emitted wave results in a superposition of the currents of the emitted and the received waves and increases thus the RF oscillation current. This current is coupled through a capacitor (C6) to a switch circuit (30) such as to trigger an alarm through actuation of the switch circuit if the RF current exceeds a defined threshold. Due to the arrangement of a non linear resistance energy sink (I) in series with the oscillator circuit (20), the switch efficiency is considerably increased by rapid variation of the supply voltage of the oscillator circuit in response to a variation of the oscillator current due to the action of the non linear resistance of the energy sink (I).

15 Claims, 3 Drawing Sheets

PORTABLE ALARM DEVICE FOR DETECTING OBJECTS TRANSGRESSING DISTANCE THRESHOLDS

FIELD OF THE INVENTION

The present invention relates to an alarm apparatus comprising a sender for electromagnetic waves including an oscillator circuit and an antenna.

BACKGROUND OF THE INVENTION

A variety of alarm apparatuses are known which use electromagnetic or ultrasonic waves in order to irradiate a certain location and to measure the reflections received from said irradiation. Be it ultrasonic devices or infrared devices, all of them have one feature in common: they only work within the limits of the walls of a room or completely outside. As the type of radiation commonly used in such known alarm devices does not traverse the walls of conventional buildings, the surveillance of the surroundings of a room can be implemented only by radiation sources located outside the room and only by a plurality of such sources which cover all angles and spots of the surroundings similar to the installation of a plurality of video cameras which need to be positioned according to the same principle if one wishes to obtain absolute protection of the room.

It is evident, that this limitation of conventional alarm systems either lead to incomplete surveillance or to high costs produced by the number of devices to be installed in order to obtain complete surveillance.

Further, known alarm systems trigger alarm signals as soon as the reflection pattern in the room or the surveyed space changes and are therefore not usefull for applications where certain changes of this pattern should be permitted without producing an alarm such as the protection of a room in which a conference is held and wherein people may move, however where the approaching of a person outside the walls of said room should be indicated in order to alert the participants of the conference that somebody may listen.

OBJECT OF THE INVENTION

It is an object of the present invention to eliminate this disadvantages and to create an alarm device which can be tuned such as to permit movements within certain areas of the surveyed space whereby alarm signals are produced only if movements occur in particular areas.

Another object of the present invention is to create an alarm device which may be used to survey simultaneously the interior and the surroundings of a room without the need of installing a plurality of radiation sources around the room.

SUMMARY OF THE INVENTION

The above mentioned and other objects of the present invention are obtained with an alarm apparatus of the type mentioned above, which is further characterized in that the oscillator circuit comprises an LC element, in that the antenna is directly coupled to the LC element, and in that the antenna and the oscillator are slightly mismatched with respect to their resonance frequency, such that the receipt by the antenna of a reflected wave which has originally been emitted from said antenna, increases the oscillation current if the reflected wave is in phase with the emitted wave which is the case when the distance between the antenna and a particular reflector is a multiple of the halve wavelength of said electromagnetic waves, said apparatus further comprising a switch circuit which is actuated in response to a transgression of a threshold of said oscillation current in either direction.

According to an embodiment of the present invention, said oscillator circuit is serially connected to a non linear resistance energy sink capable of changing from a state of low resistance to a state of high resistance in response to the amount of current flowing therethrough. Said energy sink is responsive to the current variations in the oscillator circuit which are produced by an in-phase reflection signal received in said antenna such that the resistance of said energy sink is low when such in-phase reflection signal is received in the antenna. In its state of low resistance said energy sink provides a high supply voltage for said oscillator circuit, and it provides low supply voltage for said oscillator circuit in its state of high resistance, such that the reception of an in-phase reflection signal in the antenna increases the supply voltage and the signal output voltage of said oscillator circuit which is fed to said switch circuit for triggering an alarm.

In another particular embodiment the oscillator is capable of producing an RF frequency emission wave, and the LC element is located in the collector branch of an oscillator transistor which is a part of a modified conventional RF oscillation emission circuit. In this same embodiment, the oscillator circuit may comprise a second LC element which is located between the emitter of said oscillator transistor and ground. A third LC element may be provided which is connected to said emitter in floating manner.

Due to the RF nature of the radiation in one of the possible embodiments of the present invention, the location to be surveyed may include walls or other obstacles which obstruct the direct propagation of conventionally used radiation since RF waves traverse walls without significant attenuation such that reflections obtained from obstacles outside the walls may be received by the antenna.

An energy sink may be located in the emitter branche of said oscillator transistor in series to said second LC element. Advantageously, this energy sink may be an incandescent lamp.

According to a possible embodiment of the present invention, said switch circuit may directly be connected to the coil of said LC element in the collector branch of said oscillator transistor via a coupling capacitor, whereby said switch circuit may comprise a plurality of switch transistors whereof the basis of a first switch transistor is connected to said coupling capacitor via a first diode and whereof the emitter is connected to said same coupling capacitor via a second diode, said diodes being oriented in opposite directions.

The switch circuit may comprise a second switch transistor, the basis of which is connected to the emitter of said first switch transistor and its emitter is connected to the basis of a third switch transistor who's emittor is connected to an alarm signal producing device, the collectors of all three switch transistors being connected to ground.

According to another particularity of an embodiment of the present invention, the alarm signal producing device may comprise a lamp and a sound generator, said switch circuit being connectable to the lamp or the sound generator through an alternating switch in order to preselect which type of alarm signal is desired.

The basis of said oscillator transistor may typically be connected to positive voltage through a first basis capacitor and a basis resistor in parallel thereto, as well as to ground via a second basis capacitor.

According to a particular embodiment of the present invention, the alarm apparatus comprises two symmetric oscillation circuits, which are tuned to the same frequency and connected together in series with a non linear resistance energy sink, a point between the two oscillator circuits producing an audio frequency signal if the frequency of one of the two oscillator circuits is slightly shifted by the receipt of an in-phase reflection signal in the antenna, said audio frequency signal being amplified and acoustically reproduced as alarm signal.

The present invention also relates to a method of protecting a location against intruders which method comprises the use of an alarm apparatus according to the present invention and which may be implemented by the following steps:

installing said alarm apparatus essentially in the center of the location to be surveyed; and tuning the antenna of said apparatus such as to create a slight mismatch of the oscillator and the antenna with respect to their resonance frequency under the particular reflection conditions of the location to be surveyed, such as to obtain an alarm signal each time when an intruder passes a point on one of a plurality of essentially concentric spherical surfaces around the antenna, whose radii correspond to multiples of halve wavelengths of the electromagnetic waves emitted by said antenna.

DETAILED DESCRIPTION OF THE INVENTION

Figure 1:
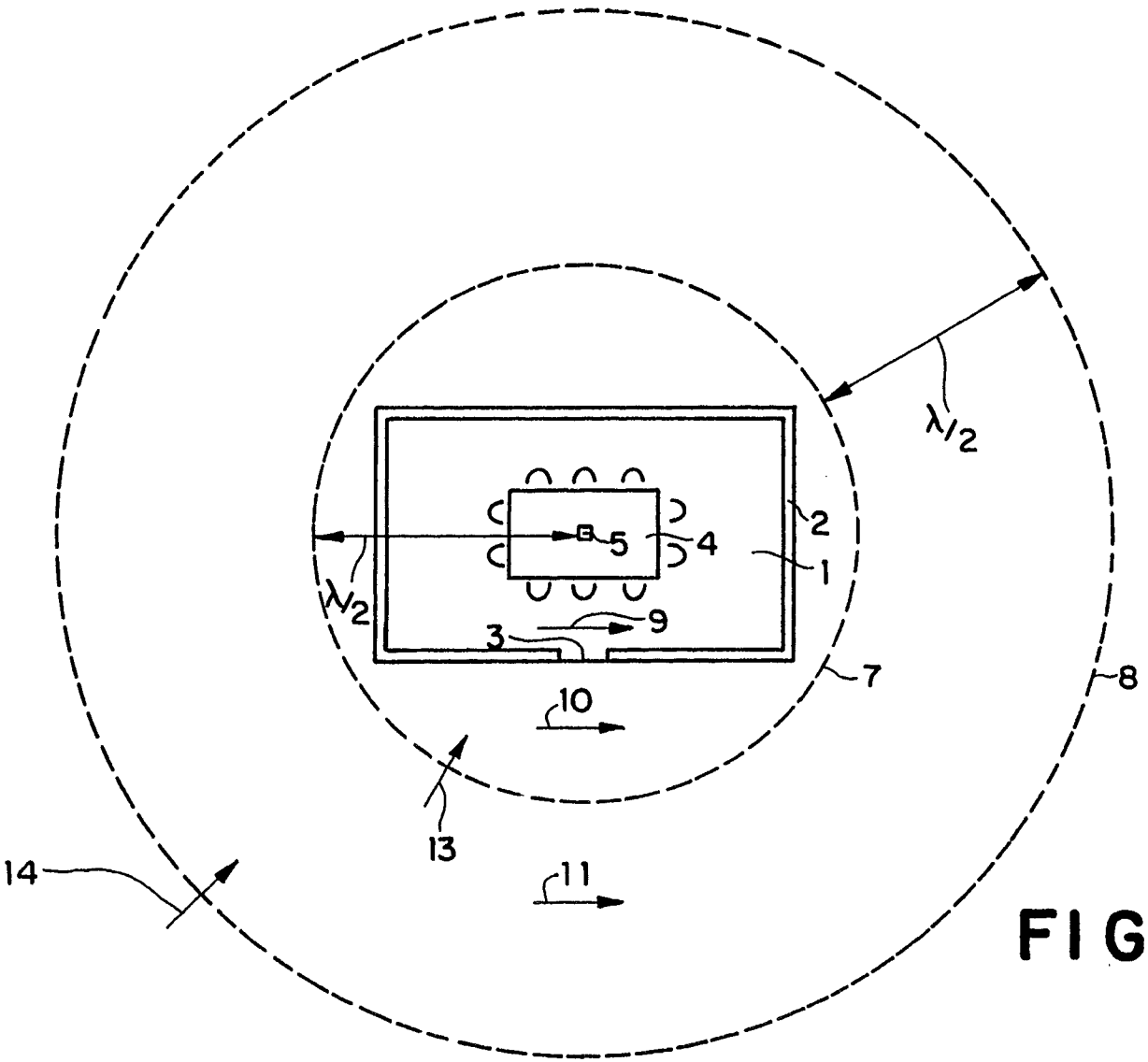
FIG. 1 shows a schematic diagram of a location to be protected by an alarm apparatus according to the present invention.

FIG. 1 illustrates schematically a conference room 1 which is contained within walls 2 and closed by a door 3. On the conference table 4, approximately in the center of the room, however optimally positioned with respect to requirements which will become clear after reading the present description, an alarm apparatus 5 according to the present invention is installed such as to irradiate the conference room and its surroundings with waves in the RF range. The particular wavelength may be selected such as to obtain the desired configuration of circles 7 and 8 (or more) which correspond to multiples of halve wavelengths $\lambda/2$ of the used RF waves.

The antenna of the alarm apparatus 5 which sends the RF waves, receives reflections from all objects within its range of transmission and is tuned such as to provide a slight mismatch of the oscillator with respect to its resonance frequency. Thus, the oscillator is in a state where it can go easily into resonance upon slight modification of the antenna current such as upon receipt of an in-phase reflection signal in the antenna. As long as no in-phase reflections are received which come from points situated on any circle 7 or 8, the oscillator remains slightly mismatched.

It is to be understood, that objects which are situated on one of those circles will return a reflection wave to the antenna which arrives there in phase with the emission signal since its trajectory corresponds to twice the halve wavelength. Thus the received reflection signal is superposed on the oscillation current in the emission oscillator (as described later) and reinforces the oscillation current, whereas all reflections which are not in-phase with the emission wave, will not increase the oscillation current.

Arrows 9, 10 and 11 represent movements of persons or objects within the same space segments relative to the halve wavelength circles 7 and 8, and are typical for movements which would not trigger an alarm. Arrows 13 and 14 represent movements whereby a person crosses a halve wavelength circle, during which an alarm would be triggered since during a point of this crossing movement, a reflection wave will be sent to the antenna which is in phase with the emission wave.

Figure 2:
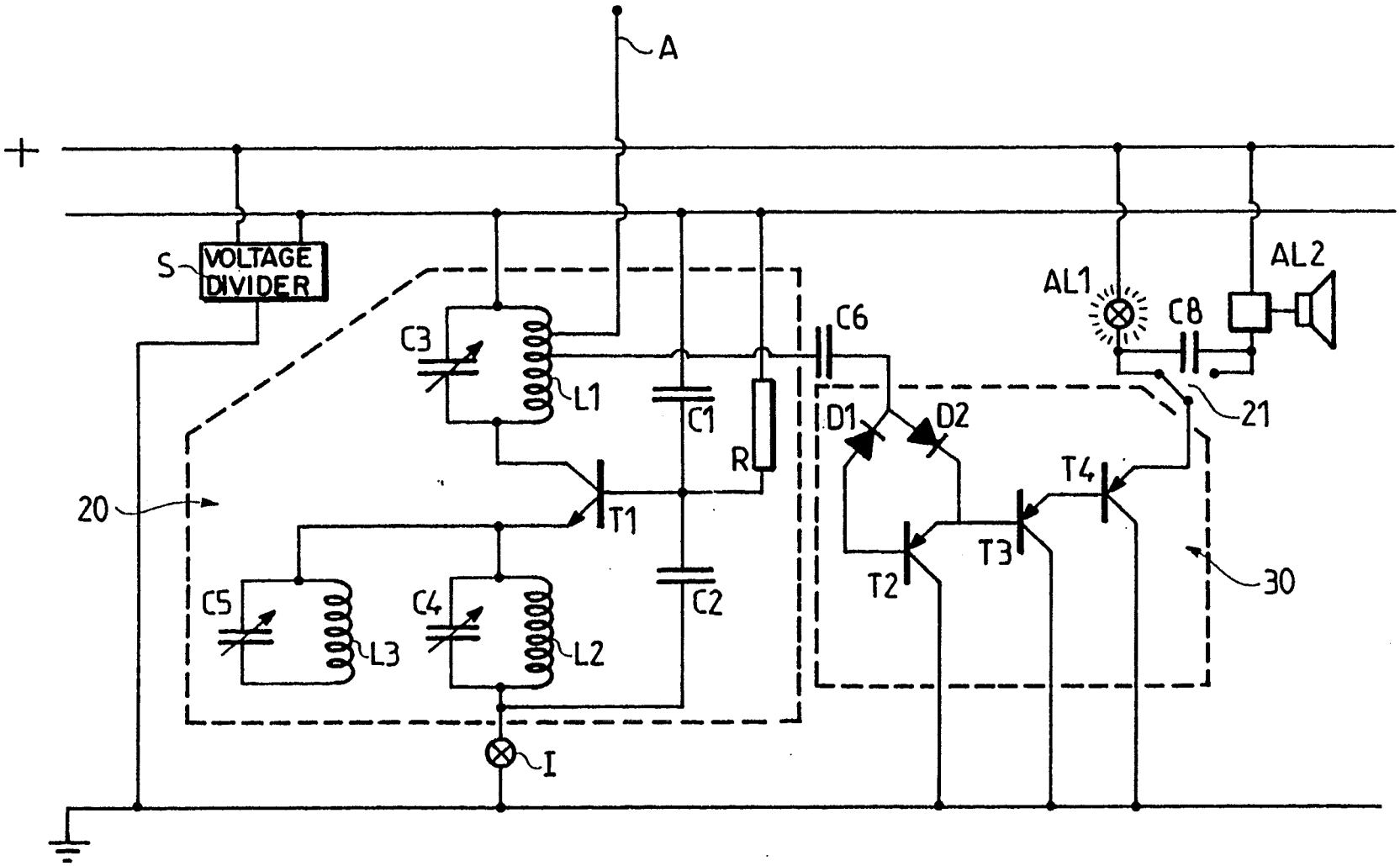
FIG. 2 is an electronic circuit diagram of an embodiment of the present invention.

FIG. 2 illustrates an electronic circuit diagram of a possible embodiment of an alarm apparatus according to the present invention.

Reference sign S designates a voltage divider, which provides an output voltage which is reduced compared to the main supply voltage of the circuit represented in FIG. 2. The main supply voltage may be e.g. 12 V and the output of the voltage divider 8 V. The 12 V voltage is used for the alarm units which will be described later and the 8 V voltage for the electronical circuit.

An RF oscillator circuit 20 comprises an oscillator transistor T1, the basis of which is kept on the proper voltage point by a resistor R which is connected to positive potential and by two capacitors C1 and C2, C1 being connected to positive potential also and C2 is connected to ground via the resistance of an incandescent lamp I which serves as non linear resistance energy sink. The collector of Transistor T1 is connected to an LC element constituted by coil L1 and capacitor C3, the time constant of this LC element corresponding to the desired RF frequency.

The emitter of transistor T1 is connected to a second LC element formed by coil L2 and capacitor C4, the time constant of this second LC element being identical to the one of the first LC element. The second LC element is further connected to the incandescent lamp I.

The emitter of transistor T1 is further connected to a third, floating LC element formed by coil L3 and capacitor C5 which is provided to counter balance the antenna which is coupled to the first LC element. All capacitors of the three LC elements are executed as adjustable capacitors.

Antenna A is connected to an intermediary contact of coil L1 of the first LC element and a second intermediary contact thereof is connected to a coupling capacitor C6 which serves to connect a switch circuit 30 to coil L1 such as to permit the passage of RF current from the coil L1 to the switch circuit 30 without ohmic connection between these two components.

The switch circuit 30 comprises three switch transistors T2, T3 and T4 as well as two diodes D1 and D2. Diode D1 is connected between the coupling capacitor C6 and the base of transistor T2 in a direction such as to permit the passing of the negative halve waves of the oscillator current into the base of transistor T2. Diode D2 is connected between the coupling capacitor C6 and the emitter of transistor T2 in a direction such as to permit the passage of the positive halve waves of the oscillator current into said emitter. It is clear therefrom, that transistor T2 will open if the oscillator current is strong enough in order to provide the necessary emitter-basis potential. When transistor T2 opens, transistors T3 and T4 which are following transistor T2 in cascade, will also open and permit one of the two alarm producing units AL1 and AL2 to be set in operation. AL1 is an optical alarm unit, e.g. in form of a lamp and AL2 is an acoustical alarm unit in form e.g. of a loudspeaker. An alternating switch 21 is provided to permit preselection of the desired type of alarm signal.

The two alarm producing units AL1 and AL2 are connected with each other by a capacitor C8 in order to provide equal impedance conditions irrespective of the choice of the type of alarm.

Antenna A is connected to an intermediary contact of coil L1 as mentioned above and receives therefrom its RF current which is radiated from the antenna A in order to provide the irradiation of the location to be surveyed by the alarm apparatus. Since the antenna is tuned such as to provide a slight resonance mismatch of the oscillator, the oscillator circuit 20 does not operate in its resonance frequency and the amplitude of the oscillator current is therefore not in saturation. If an in-phase reflection is captured by the antenna A, the antenna current produced by this received wave is superposed over the oscillator current for the emission wave and increases thus said oscillator current which leads to an increase of the RF current flowing through the coupling capacitor C6 resulting in the actuation of the switch circuit 30 and consequently in the triggering of one of the two alarm units AL1 and AL2.

In the equilibrium case where no in-phase reflection signals are received at the antenna A, the oscillator operates slightly outside resonance and the RF output voltage is therefore small. In this case, the DC current through the oscillator, and accordingly through the lamp I, which is connected in series thereto, is high, so that the lamp is burning and produces heat which results in a state of high resistance thereof. In this case, a large portion of the circuit supply voltage drops across the lamp, and the remaining oscillator supply voltage is relatively low, so that the RF output voltage is also low. The RF signal which is fed to the switch circuit 30 is therefore too small to open transistor T2.

If an in-phase reflection signal is received in the antenna A, the oscillation of the LC element L1, C3 goes closer to or ino resonance and increases therefore the amplitude of the RF current in the oscillator circuit. Transistor T1 works in a range where the DC current is reduced if the RF current increases, so that the receipt of an in-phase reflection signal which increases the RF current results in a decrease of the DC component of the oscillator current. This results further in an extinction of the lamp I which decreases the resistance of the lamp, increases consequently the remaining supply voltage of the oscillator circuit and produces herewith a sharp increase of the RF output voltage of the oscillator. This sharp increase is communicated to the switch circuit 30 which triggers an alarm.

Thus, the receipt in antenna A of an in-phase reflection wave, produced by the reflection of an emitted RF wave at one of the halve wave circles, results in the triggering of an alarm signal.

Figure 3:
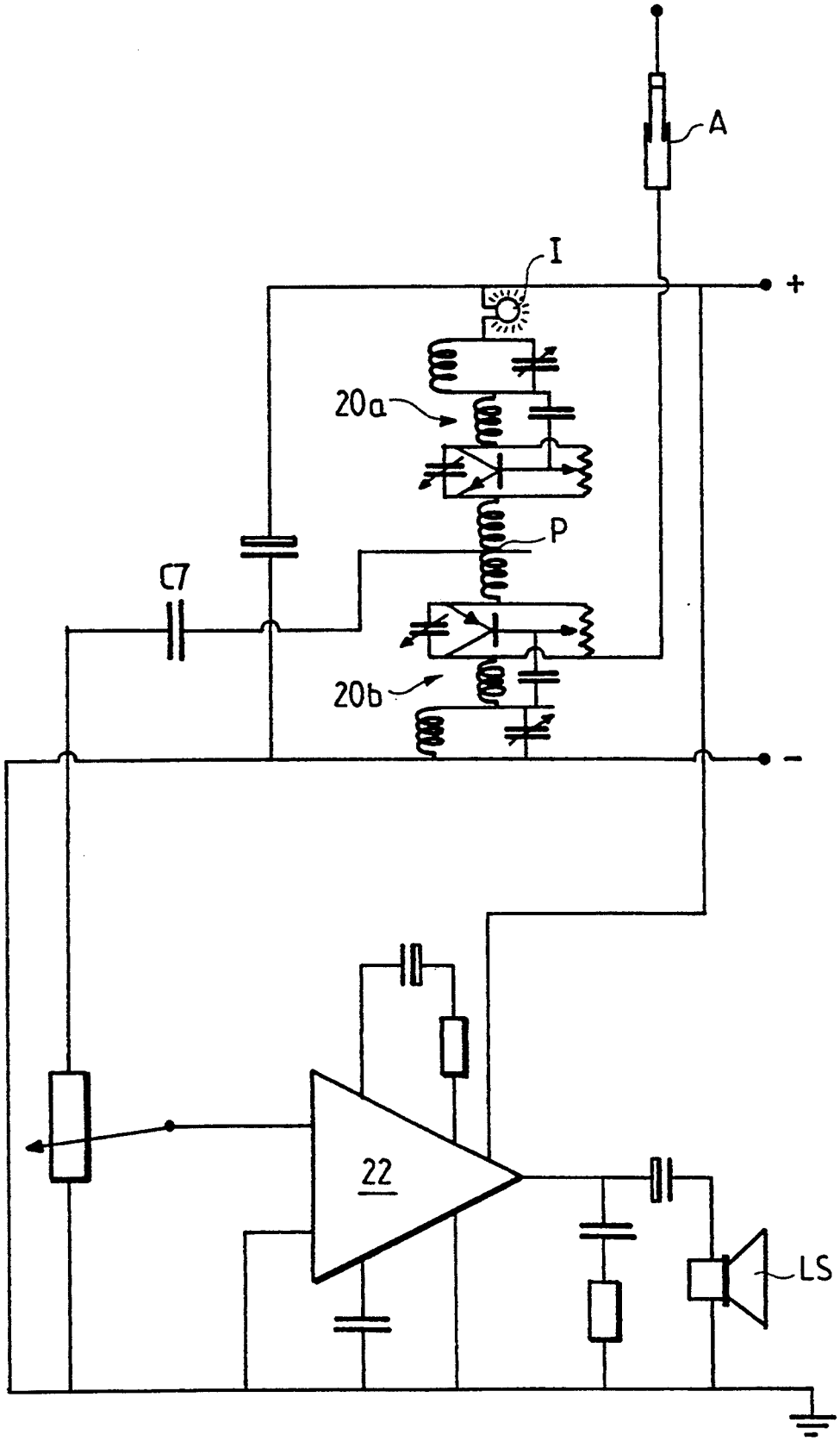
FIG. 3 is an electronic circuit diagram of another embodiment of the present invention.

FIG. 3 shows the electronic circuit diagram of another embodiment of the present invention. In this embodiment the oscillator circuit comprises two symmetric RF oscillators 20*a* and 20*b* which are tuned to the same frequency, whereof only one oscillator, 20*b*, is connected to the antenna A. If no in-phase reflection signal is received in antenna A, point P receives an RF signal of possibly attenuated amplitude. If, however, an in-phase reflection signal comes from antenna A into oscillator 20*b*, the frequency of oscillator circuit 20*b* is slightly changed and point P receives therefore an audio frequency oscillation corresponding to the difference of frequencies of the two oscillator circuits.

The two oscillator circuits are connected in series together with lamp I which serves to increase the speed of response of the frequency variation of oscillator 20*b* to the received antenna signal, in a mannersimilar to that described under FIG. 2.

The audio frequency current from point P is again decoupled through capacitor C7 and directly fed into an operational amplifier 22 whose output is fed into a loudspeaker LS.

The present invention has been described above with reference to embodiments, it being understood, that various modifications may be made which appear obvious to the expert in the art without departing from the spirit and scope of the invention.

I claim:

1. An alarm apparatus comprising an oscillator circuit (20) having an LC element (L1, C3) and an antenna (A) coupled to the LC element, the antenna and the oscillator circuit each having a resonance frequency, the resonance frequency of the antenna being slightly mismatched with respect to the resonance frequency of the oscillator circuit, the oscillator circuit having an oscillator current including an amplitude, the amplitude of the oscillation current being increased when electromagnetic waves emitted from the antenna and reflected by an object at a distance corresponding to a multiple of a half wavelength ($\lambda/2$) of the emitted waves are received by the antenna, the increased amplitude being indicative of a transgression of a perimeter by the object, the perimeter comprising a circle having a radius corresponding to the multiple of the half wavelength of the emitted waves, the alarm apparatus also comprising a switch circuit (30) coupled to the oscillator circuit, the switch circuit being actuated by the increased amplitude of the oscillation current to provide an indication of the transgression.

2. The alarm apparatus of claim 1, characterized in that said oscillator circuit (20) is serially connected to a non linear resistance energy sink (I) capable of changing from a state of low resistance to a state of high resistance in response to the amount of current flowing therethrough.

3. The alarm apparatus of claim 2, characterized in that said energy sink (I) is responsive to the current variations in the oscillator circuit (20) which are produced by an in-phase reflection signal received in said antenna (A) such that the resistance of said energy sink (I) is decreased when such in-phase reflection signal is received in the antenna.

4. The alarm apparatus of claim 2, characterized in that in its state of low resistance said energy sink (I) provides a high supply voltage for said oscillator circuit (20), and in that it provides low supply voltage for said oscillator circuit in its state of high resistance, such that the reception of an in-phase reflection signal in the antenna (A) increases the supply voltage and the signal output voltage of said oscillator circuit (20) which is fed to said switch circuit (30) for triggering an alarm.

5. The alarm apparatus of claim 1, characterized in that said oscillator circuit (20) is an RF oscillator capable of producing an RF emission wave, and in that said LC element (L1,C3) is located in the collector branch of an oscillator transistor (T1).

6. The alarm apparatus of claim 5, characterized in that said oscillator circuit (20) comprises a second LC element (L2, C4) which is located between the emitter of said oscillator transistor (T1) and ground.

7. The alarm apparatus of claim 6, characterized in that said oscillator circuit (20) comprises a third LC element (L3, C5) which is connected to said emitter in floating manner.

8. The alarm apparatus of claim 5, characterized in that an energy sink (I) is located in the emitter branch of said oscillator transistor (T1) in series to said second LC element (L2, C4).

9. The alarm apparatus of claim 8, characterized in that said energy sink (I) is an incandescent lamp.

10. The alarm apparatus of claim 1, characterized in that said switch circuit (30) is directly connected to the coil (L1) of said first LC element in the collector branch of an oscillator transistor (T1) via a coupling capacitor (C6), said switch circuit (30) comprising a plurality of switch transistors (T2, T3, T4) whereof the basis of a first switch transistor (T2) is connected to said coupling capacitor (C6) via a first diode (D1) and whereof the emitter is connected to said same coupling capacitor (C6) via a second diode (D2), whereby said diodes are oriented in opposite directions.

11. The alarm apparatus of claim 1, characterized in that it comprises two symmetric oscillation circuits (20*a*, 20*b*), which are connected together in series with a non linear resistance energy sink (I), a point (P) between the two oscillator circuits receiving an audio frequency signal if the frequency of one of the two oscillator circuits is shifted by the receipt of an in-phase reflection signal in the antenna (A), and in that said audio frequency signal is amplified and acoustically reproduced as alarm signal.

12. The alarm apparatus of claim 10, characterized in that said switch circuit (30) comprises a second switch transistor (T3), the base of which is connected to the emitter of said first switch transistor (T2) and its emitter is connected to the base of a third switch transistor (T4) whose emitter is connected to an alarm signal producing device (AL1, AL2), the collectors of all three switch transistors (T1, T2, T3) being connected to ground.

13. The alarm apparatus of claim 12, characterized in that said alarm signal producing device (AL1, AL2) comprises a lamp (AL1) and a sound generator (AL2), said switch circuit (30) being connectable to the lamp (AL1) or the sound generator (AL2) through an alternating switch (21).

14. The alarm apparatus of claim 12, characterized in that the base of said oscillator transistor (T1) is connected to positive voltage through a first base capacitor (C1) and a base resistor (R) in parallel thereto, as well as to ground via a second base capacitor (C2).

15. A method for protecting a location against intruders comprising the steps of:

installing an alarm apparatus essentially in the center of the location, the apparatus comprising an oscillator circuit (20) having an LC element (L1, C3) and an antenna (A) coupled to the LC element, the antenna and the oscillator circuit each having a resonance frequency, the oscillator circuit having an oscillator current including an amplitude,; and tuning the antenna to create a slight mismatch between the resonance frequency of the oscillator and the resonance frequency of the antenna such that the amplitude of the oscillation current increases when electromagnetic waves emitted from the antenna and reflected by an object at a distance corresponding to a multiple of a half wavelength ($\lambda/2$) of the emitted waves are received by the antenna, the increased amplitude being indicative of a transgression of a perimeter by an intruder, the perimeter comprising a circle having a radius corresponding to the multiple of the half wavelength of the emitted waves.

* * * * *

UNITED STATES PATENT AND TRADEMARK OFFICE

CERTIFICATE OF CORRECTION

PATENT NO. : 5,367,288
DATED : November 22, 1994
INVENTOR(S) : Saqr Majed El Marry It is certified that error appears in the above-indentified patent and that said Letters Patent is hereby corrected as shown below:

On the title page, item [76], "Saar" should read --Saqr--.

Signed and Sealed this

Twenty-third Day of May, 1995

*Attest:*

Bruce Lehman

BRUCE LEHMAN

*Attesting Officer*

*Commissioner of Patents and Trademarks*